US006277055B1

(12) United States Patent
Birrell et al.

(10) Patent No.: US 6,277,055 B1
(45) Date of Patent: Aug. 21, 2001

(54) FLEXIBLY COORDINATED STATIONARY EXERCISE DEVICE

(75) Inventors: James S. Birrell, Seattle; William W. Potts, Medina; Thomas Moran, Seattle, all of WA (US)

(73) Assignee: Illinois Tool Works, Inc., Glenview, IL (US)

( * ) Notice: Subject to any disclaimer, the term of this patent is extended or adjusted under 35 U.S.C. 154(b) by 0 days.

(21) Appl. No.: 09/298,349

(22) Filed: Apr. 23, 1999

Related U.S. Application Data

(63) Continuation-in-part of application No. 09/271,733, filed on Mar. 18, 1999, now Pat. No. 6,165,107.

(51) Int. Cl.[7] ..... A63B 22/00; A63B 22/04

(52) U.S. Cl. ..... 482/52; 482/51; 482/70

(58) Field of Search ..... 482/51, 52, 53, 482/57, 70, 79, 80

(56) References Cited

U.S. PATENT DOCUMENTS

| | | |
|---|---|---|
| 219,439 | 9/1879 | Blend . |
| D. 229,369 | 11/1973 | Smith et al. . |
| D. 330,236 | 10/1992 | Jarriel et al. . |
| D. 372,282 | 7/1996 | Pasero . |
| D. 408,477 | 4/1999 | Arnold et al. . |
| D. 410,978 | 6/1999 | Littrell et al. . |
| 518,757 | 4/1894 | Hoyt . |
| 1,273,906 | 7/1918 | Nickey . |
| 1,323,004 | 11/1919 | Boyd . |
| 2,603,486 | 7/1952 | Hughes . |
| 2,641,249 | 6/1953 | Brockman . |
| 2,826,192 | 3/1958 | Mangas . |
| 2,892,455 | 6/1959 | Hutton . |
| 3,316,898 | 5/1967 | Brown . |
| 3,432,164 | 3/1969 | Deeks . |
| 3,475,021 | 10/1969 | Ruegsegger . |
| 3,566,861 | 3/1971 | Weiss . |
| 3,713,438 | 1/1973 | Knutsen . |
| 3,759,511 | 9/1973 | Zinkin et al. . |
| 3,824,994 | 7/1974 | Soderberg, Sr. . |
| 4,023,795 | 5/1977 | Pauls . |
| 4,053,173 | 10/1977 | Chase, Sr. . |
| 4,185,622 | 1/1980 | Swenson . |
| 4,188,030 | 2/1980 | Hooper . |

(List continued on next page.)

FOREIGN PATENT DOCUMENTS

| | | |
|---|---|---|
| 0206208 | 7/1939 | (CH) . |
| 29 19 494 | 11/1980 | (DE) . |
| 1600816 | 10/1990 | (RU) . |

*Primary Examiner*—Stephen R. Crow
(74) *Attorney, Agent, or Firm*—Christensen O'Connor Johnson Kindness PLLC

(57) ABSTRACT

The flexibly coordinated stationary exercise device (10) includes a frame (12) which has a forward upright member (20). The axle mounts (30) and (32) are attached to the rear region of the frame (12) and support a transverse axle (36) which is preferably operatively connected to a flywheel (38). The ends of the transverse axle (36) rotatably engage left and right crank arm assemblies (50) and (52) that are coupled to the left and right foot links (60) and (70) so that the foot links travel in an arcuate reciprocal path as the transverse axle rotates. The foot links are operatively connected to swing arm mechanisms (80) and (90), which in turn are rotatably connected to the forward upright member (20) at pivot points (84) and (94). The swing arm mechanisms further contain hand-gripping portions (82) and (92), and the foot links further contain foot support portions (66) and (76). Flexibly coordinating members (100) are incorporated in the linkage between each respective hand-gripping portion and foot support portion to substantially and resiliently link the movement of the foot support portions to the movement of the hand-gripping portions, while permitting some degree of uncoordinated motion between the foot support portions and the hand-gripping portions.

33 Claims, 3 Drawing Sheets

U.S. PATENT DOCUMENTS 4,379,566 4/1983 Titcomb .
4,456,276 6/1984 Bortolin .
4,505,473 3/1985 Pro .
4,509,742 4/1985 Cones .
4,555,109 11/1985 Hartmann .
4,561,318 12/1985 Schirrmacher .
4,645,200 2/1987 Hix .
4,679,786 7/1987 Rodgers .
4,700,946 10/1987 Breunig .
4,720,093 1/1988 Del Mar .
4,779,863 10/1988 Yang .
4,786,050 11/1988 Geschwender .
4,842,268 6/1989 Jenkins .
4,869,494 9/1989 Lambert, Sr. .
4,900,013 2/1990 Rodgers, Jr. .
4,949,954 8/1990 Hix .
4,949,993 8/1990 Stark et al. .
4,986,261 1/1991 Iams et al. .
4,989,857 2/1991 Kuo .
5,029,848 7/1991 Sleamaker .
5,038,758 8/1991 Iams et al. .
5,039,087 8/1991 Kuo .
5,039,088 8/1991 Shifferaw .
5,131,895 7/1992 Rogers, Jr. .
5,135,447 8/1992 Robards, Jr. et al. .
5,149,312 9/1992 Croft et al. .
5,169,363 12/1992 Campanaro et al. .
5,186,697 2/1993 Rennex .
5,242,343 9/1993 Miller .
5,269,736 12/1993 Roberts .
5,279,529 1/1994 Eschenbach .
5,279,530 1/1994 Hess .
5,290,211 3/1994 Stearns .
5,295,928 3/1994 Rennex .
5,299,993 4/1994 Habing .
5,352,169 10/1994 Eschenbach .
5,383,829 1/1995 Miller .
5,387,167 2/1995 Johnston .
5,401,226 3/1995 Stearns .
5,403,255 4/1995 Johnston .
5,423,729 6/1995 Eschenbach .
5,499,956 3/1996 Habing et al. .
5,518,473 5/1996 Miller .
5,527,246 6/1996 Rodgers, Jr. .
5,529,554 6/1996 Eschenbach .
5,540,637 7/1996 Rodgers, Jr. .
5,549,526 8/1996 Rodgers, Jr. .
5,562,574 10/1996 Miller .
5,573,480 11/1996 Rodgers, Jr. .
5,577,985 11/1996 Miller .
5,593,371 1/1997 Rodgers, Jr. .
5,593,372 1/1997 Rodgers, Jr. .
5,595,553 1/1997 Rodgers, Jr. .
5,611,756 3/1997 Miller .
5,637,058 6/1997 Rodgers, Jr. .
5,653,662 8/1997 Rodgers, Jr. .
5,683,333 11/1997 Rodgers, Jr. .
5,685,804 11/1997 Whan-Tong et al. .
5,690,589 11/1997 Rodgers, Jr. .
5,738,614 4/1998 Rodgers, Jr. .
5,743,834 4/1998 Rodgers, Jr. .
5,766,113 6/1998 Rodgers, Jr. .
5,772,558 6/1998 Rodgers, Jr. .
5,848,954 12/1998 Stearns et al. .
5,857,941 1/1999 Maresh et al. .
5,897,461 4/1999 Socwell .

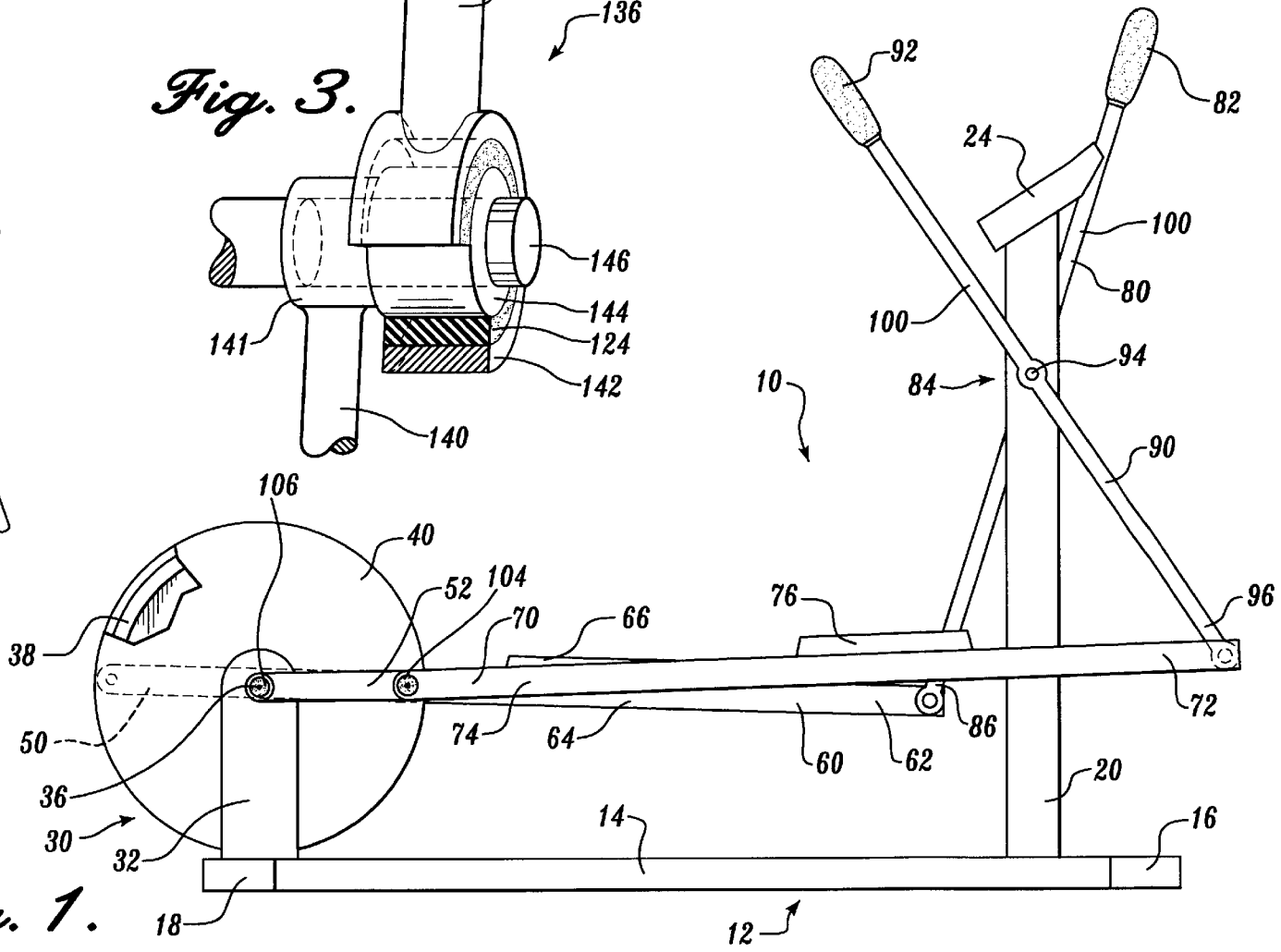
Fig. 1.
Fig. 3.
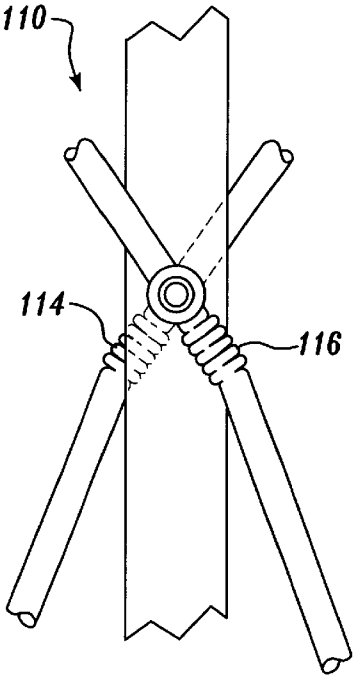
Fig. 2.

FLEXIBLY COORDINATED STATIONARY EXERCISE DEVICE

Related Applications

This application is a continuation-in-part of U.S. patent application Ser. No. 09/271,733, filed on Mar. 18, 1999., now U.S. Pat. No. 6,165,107.

FIELD OF THE INVENTION

The present invention relates to exercise equipment, and more specifically to a stationary exercise device that resiliently links upper and lower body movements in flexibly coordinated motion.

BACKGROUND OF THE INVENTION

The benefits of regular aerobic exercise have been well established and accepted. However, due to time constraints, inclement weather, and other reasons, many people are prevented from aerobic activities such as walking, jogging, running, and swimming. In response, a variety of exercise equipment have been developed for aerobic activity. It is generally desirable to exercise a large number of different muscles over a significantly large range of motion so as to provide for balanced physical development, to maximize muscle length and flexibility, and to achieve optimum levels of aerobic exercise. A further advantageous characteristic of exercise equipment, is the ability to provide smooth and natural motion, thus avoiding significant jarring and straining that can damage both muscles and joints.

While various exercise systems are known in the prior art, these systems suffer from a variety of shortcomings that limit their benefits and/or include unnecessary risks and undesirable features. For example, stationary bicycles are a popular exercise system in the prior art, however this machine employs a sitting position which utilizes only a relatively small number of muscles, throughout a fairly limited range of motion. Cross-country skiing devices are also utilized by many people to simulate the gliding motion of cross-country skiing. While this device exercises more muscles than a stationary bicycle, the substantially flat shuffling foot motion provided thereby, limits the range of motion of some of the muscles being exercised. Another type of exercise device simulates stair climbing. These devices also exercise more muscles than do stationary bicycles, however, the rather limited range of up-and-down motion utilized does not exercise the user's leg muscles through a large range of motion. Treadmills are still a further type of exercise device in the prior art, and allow natural walking or jogging motions in a relatively limited area. A drawback of the treadmill, however, is that significant jarring of the hip, knee, ankle and other joints of the body may occur through use of this device.

A further limitation of a majority of exercise systems in the prior art, is that the systems are limited in the types of motions that they can produce, such as not being capable of producing elliptical motion. Exercise systems create elliptical motion, as referred to herein, when the path traveled by a user's feet while using the exercise system follows an arcuate or ellipse-shaped path of travel. Elliptical motion is much more natural and analogous to running, jogging, walking, etc., than the linear-type, back and forth motions produced by some prior art exercise equipment.

Exercise devices are also desirable which provide the additional advantage of being configured to provide arm and shoulder motions, as well as arcuate foot motions. Prior art devices utilizing arm and shoulder motions that are linked to foot motions incorporate forced coordinated motion, where the motions of a user's feet are linked to the motions of a user's arms and shoulders, so that one's feet are forced to move in response to the movement of one's arms and shoulders (in substantially an equal and opposite amount), and vice versa. Still other prior art devices limit the range of motions utilized by their systems, which can result in detrimental effects on a user's muscle flexibility and coordination due to the continued reliance on the small range motion produced by these exercise devices, as opposed to the wide range of natural motions that are experienced in activities such as running, walking, etc.

Despite the large number of exercise devices known in the prior art there is still a need for an exercise device which produces elliptical foot movement, and incorporates substantially related arm, shoulder, and rotational motions that are linked to the foot movements in a flexible and resilient manner. Exercise devices are desired that provides for a smooth stepping-running motion that prevents trauma to joints and muscles, while exercising a user's legs more fully than cycling or skiing devices. There is a continuing need for an exercise device that provides for smooth natural action, exercises a relatively large number of muscles through a large range of elliptical motion, employs arm, shoulder, and rotational movement, and allows for flexibly coordinated motion between the upper and lower body, i.e., motion that is substantially coordinated but still allows for some independent or uncoordinated motion between the movement of the user's feet.

SUMMARY OF THE INVENTION

The present invention is directed towards an exercise device that allows flexibly coordinated motion to be produced between a user's hands and feet. The exercise device utilizes a frame to which a transverse axis is mounted. Coupling mechanisms are configured to operatively associate with foot links for associating the foot links to the transverse axis such that the foot support portion of each foot link travels in a reciprocal path as the transverse axis rotates. Each foot link includes a first end portion, a second end portion and a foot support portion therebetween. Swing arm mechanisms, which include a gripping portion, a pivot point, and a coupling region, operatively associate the coupling region of each swing arm mechanism with the respective first end portion of each foot link. Flexibly coordinating members substantially and resiliently link the movement of the foot support portions to the movement of the hand gripping portions of the swing arm mechanisms, while permitting some degree of uncoordinated motion between the foot support portions and the hand gripping portions.

In a preferred embodiment of the present invention, the coupling mechanisms comprise rotational crank arms that pivotally associate the transverse axis with the foot links. Preferably, at least a portion of the coupling mechanisms rotate about the transverse axis. The exercise device may further include a flywheel disposed for rotation in operative connection with the transverse axis. A resistance system, configured in operatively associated with the transverse axis, may also be included in the device to thereby increase the level of exercise required from the user.

In one preferred embodiment of the present invention, the swing arm mechanisms themselves act as the flexibly coordinating members. In this embodiment a substantial portion of the swing arm mechanisms are constructed of a material that is sufficiently flexible and resilient to substantially link the movement of the foot links to the movement of the hand gripping portions of the swing arm mechanisms.

In another preferred embodiment of the present invention, the swing arm mechanisms include spring link members that act as the flexibly coordinating members. Preferably, the spring link members of the swing arm mechanisms are located substantially adjacent to the pivot points of the swing arm mechanisms. In still another preferred embodiment of the present invention, the swing arm mechanisms include elastomeric torsion members that are located substantially adjacent to the pivot points, and which act as the flexibly coordinating members that flexibility connect the gripping portions to the coupling regions of the swing arm mechanisms.

Further, in yet another preferred embodiment of the present invention, the flexibly coordinating members operatively connect the second end portion of the foot links with coupling region of the swing arm mechanisms. In this embodiment the flexibly coordinating members comprise spring members. Elastomeric members may also be employed instead of spring members to operatively associate the second end portion of the foot links with coupling region of the swing arm mechanisms, and thereby act as the flexibly coordinating members.

In another aspect of a preferred embodiment, the exercise device comprises at least one flexibly coordinating mechanism in operative association between the foot links that substantially relates the movement of the first and second foot links to each other, while permitting some degree of uncoordinated motion between the foot links. Flexibly coordinating mechanisms may be incorporated between each foot link and its respective coupling mechanism. In another embodiment, flexibly coordinating mechanisms may be incorporated between each coupling mechanism and the transverse axis. In still another embodiment, the flexibly coordinating mechanism may be configured as a flexibly coordinated, bifurcated transverse axis which substantially relates the movement of the first and second foot links to each other, while permitting some degree of uncoordinated motion between the foot links.

An exercise device constructed in accordance with the present invention implements flexibly coordinated motion between a user's hands and feet to simulate natural walking and running motions and exercise a large number of muscles. Increased muscle flexibility and coordination can also be derived through the smooth, natural, flexibly coordinated motion of the present invention, as opposed to the unforgiving forced coordinated motions produced between a user's hands and feet in some prior art exercise equipment. This device provides the above stated benefits without imparting the shock to the user's body joints in the manner of prior art exercise treadmills.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein:

FIG. 1 illustrates a side view of an flexibly coordinated stationary exerciser of the present invention, that utilizes the swing arm mechanisms as flexibly coordinating members;

FIG. 2 illustrates a close-up side view of a portion of the flexibly coordinated exerciser of the present invention, that utilizes spring link members in the swing arm mechanisms adjacent the pivot points as flexibly coordinating members;

FIG. 3 illustrates a close-up perspective view of a portion of the flexibly coordinated exerciser of the present invention, that utilizes elastomeric torsion members at pivot connection points between upper handle bars and lower swing arms as flexibly coordinating members;

DETAILED DESCRIPTION OF THE PREFERRED EMBODIMENT

Figure 4:
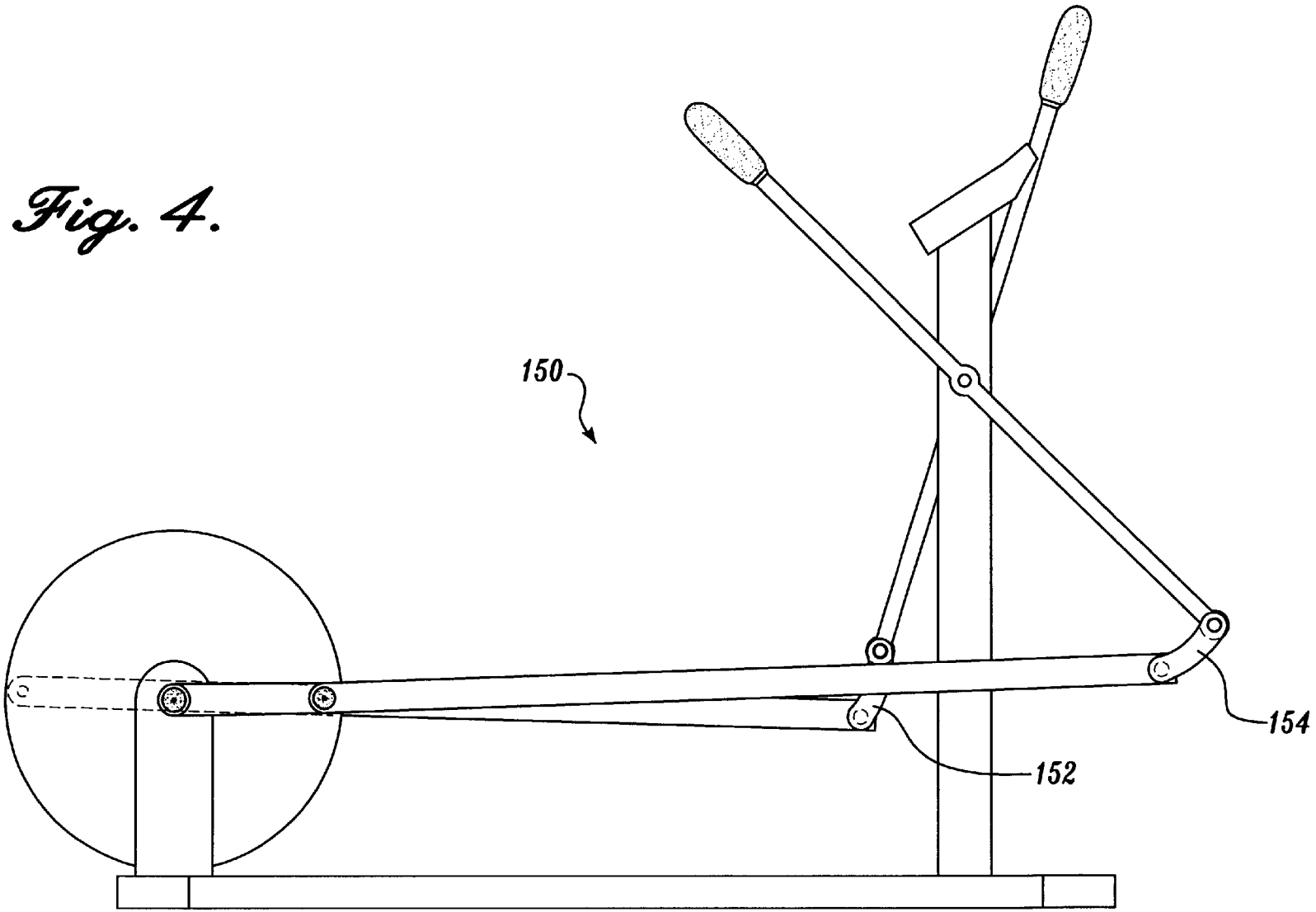
FIG. 4 illustrates a side view of the flexibly coordinated exerciser of the present invention, that utilizes elastomeric members at the connections between the swing arms and the foot links as flexibly coordinating members.

FIG. 1 illustrates a preferred embodiment of a flexibly coordinated stationary exercise device 10 constructed in accordance with the present invention. Briefly described, the exerciser 10 includes a frame 12 which has a forward upright member 20 that extends upward from a substantially horizontal, longitudinal central member 14 of the frame 12. Towards the rear region of the frame 12 are upwardly extending left and right axle mounts 30 and 32. The axle mounts 30 and 32 support a transverse axle 36 which is preferably operatively connected to a flywheel 38. The left and right ends of the transverse axle 36 rotatably engage left and right crank arm assemblies 50 and 52. Left and right foot links 60 and 70 have rearward ends 64 and 74 which engage the crank arm assemblies 50 and 52 such that the rear ends of the foot links travel in an arcuate reciprocal path as the transverse axle 36 rotates.

The foot links 60 and 70 have forward ends 62 and 72 that are operatively connected to the coupling regions 86 and 96 of left and right swing arm mechanisms 80 and 90, respectively. The swing arm mechanisms 80 and 90 are rotatably connected to the forward upright member 20 of the frame 12 at their respective pivot points 84 and 94. The swing arm mechanisms 80 and 90 further contain left and right hand-gripping portions 82 and 92, and the foot links 60 and 70 further contain left and right foot support portions 66 and 76. Flexibly coordinating members 100 are incorporated in the linkage of the exercise device 10 between each respective hand-gripping portion 82 and 92, and foot support portion 66 and 76. The flexibly coordinating members substantially and resiliently link the movement of the foot support portions 66 and 76 to the movement of the hand-gripping portions 82 and 92, while permitting some degree of uncoordinated motion between the foot support portions and the hand-gripping portions.

The embodiment of the present invention as shown in FIG. 1 will now be described in more detail. The frame 12 includes a longitudinal central member 14 that terminates at front and rear, relatively shorter transverse members 16 and 18. Ideally, but not essentially, the frame 12 is composed of rectangular tubular members that are relatively light in weight but that provide substantial strength and rigidity. When tubular members are utilized end caps (not shown) are preferably securably connected to the open ends of the front and rear transverse members 16 and 18 to close off ends of these members. The frame 12 may also be composed of solid members that provide the requisite strength and rigidity while maintaining a relatively light weight.

The forward upright member 20 extends upwardly from the forward region of the floor engaging frame 12. Preferably, the upright member 20 is substantially vertical.

However, the forward member 20 may be configured at an upward angulation without departing from the scope of the present invention. Ideally, but not essentially, the forward upright member 20 is also composed of a rectangular tubular material, as described above. Preferably, a view screen 24 is securably connected to the upper end of the forward upright member 20, at an orientation easily viewable to a user of the device 10. Instructions for operating the device may be located on the view screen 24 in an exemplary embodiment. In some embodiments of the present invention, electronic devices may be incorporated into the exerciser device 10 such as timers, odometers, speedometers, heart rate indicators, energy expenditure recorders, etc. This information may be routed to the view screen 24 for ease of viewing for a user of the device 10.

In the exemplary preferred embodiment shown in FIG. 1, the axle mounts 30 and 32 are located toward the rear of the frame 12. The axle mounts 30 and 32 are attached to the frame 12 and extend approximately upward from the substantially horizontal, longitudinal central member 14. The transverse axle 36 is rotatably housed in the upper region of the axle mounts 30 and 32. These regions of the axle mounts 30 and 32 which house the ends of the transverse axle 36 contain low friction engaging systems (not shown), such as bearing systems, to allow the transverse axle 36 to rotate with little resistance within the housing in the axle mounts 30 and 32.

Referring again to the exemplary preferred embodiment shown in FIG. 1, the transverse axle 36 connects to a flywheel 38 contained within a center housing 40. Such flywheels are known in the art. However, in other preferred embodiments, the transverse axle 36 may not incorporate a flywheel 38 and central housing 40, without departing from the scope of the present invention (provided that the foot links 60 and 70 are coupled to one another in some fashion, albeit directly or indirectly). The transverse axle 36 may also be operatively connected to a capstan-type drive (not shown) in some embodiments, to allow the axle 36 to rotate in only one direction.

The elliptical motion exerciser 10 further contains longitudinally extending left and right foot links 60 and 70. As shown in FIG. 1, the foot links are illustrated in the shape of elongated, relatively thin beams. The foot links 60 and 70 are of a width substantial enough to accommodate the width of an individual user's foot. The foot links 60 and 70 are aligned in approximately parallel relationship with the longitudinal central member 14 of the frame 12. The foot support portions 66 and 76 are positioned near the center to front region of the foot links 60 and 70, and comprise engagement pads, to assist in providing stable foot placement locations for an individual user. In some exemplary embodiments the foot support portions 66 and 76 are configured to form toe straps and/or toe and heel cups (not shown) which aid in forward motion recovery at the end of a rearward or forward striding motion of a user's foot.

Left and right crank arm assemblies 50 and 52 connect the rearward ends 64 and 74 of the foot links 60 and 70 to the ends of the transverse axle 36. In a preferred embodiment of the present invention shown in FIG. 1, the crank arm assemblies 50 and 52 are comprised of only a single left and right crank arm member. In this exemplary embodiment the proximal ends of the crank arm members 50 and 52 engage the ends of the transverse axle 36, while the distal ends of the crank arm members 50 and 52 are rotatably connected to the rearward ends 64 and 74 of the foot links 60 and 70. In this configuration, the rearward ends 64 and 74 of the foot links 60 and 70 rotate about the transverse axle 36 as the axle rotates, and the foot support portions 66 and 76 of the foot links 60 and 70 travel in a reciprocal, elliptical path of motion. However, the elliptical path of the foot support portions 66 and 76, and indeed the motion of the entire foot links 60 and 70 can be altered into any number of configurations by changing the composition or dimensions of the crank arm assemblies 50 and 52. For example, the length of the single left and right crank arms shown in FIG. 1 can be lengthened or shortened to modify the path of the foot links 60 and 70. Further, the left and right crank arm assemblies 50 and 52 can be composed of multiple crank arm member linkages to alter the path of travel of the foot links 60 and 70 in a wide variety of aspects.

In an alternate embodiment of the present invention the rearward end 64 and 74 of the foot links 60 and 70 are rotationally connected directly to a flywheel which functions to couple the foot links 60 and 70 to a pivot axis (equivalent to the axis of the transverse axle 36) and permit rotation thereabout. In this embodiment, the flywheel is preferably a double flywheel that supports rotation about a central axis. It will also be appreciated that various mechanical arrangements may be employed to embody the crank arm assemblies 50 and 52 in operatively connecting the foot links 60 and 70 to each other. Such variations may include a larger flywheel, a smaller flywheel or may eliminate the flywheel entirely and incorporate a cam system with connecting linkage, provided that the foot links are coupled so as to permit an arcuate path of travel by the foot support portions 66 and 76 of the foot links 60 and 70.

Referring again to FIG. 1, the exerciser device 10 further contains left and right swing arm mechanisms 80 and 90. Respectively, each swing arm mechanism 80 and 90 contains a hand-gripping portion 82 and 92, a pivot point 84 and 94, and a coupling region 86 and 96. The coupling regions 86 and 96 of the swing arm mechanisms 80 and 90 rotatably connect to the forward ends 62 and 72 of the foot links 60 and 70. The pivot points 84 and 94 rotatably secure the swing arm mechanisms 80 and 90 to the forward upright member 20 of the frame 12. The hand-gripping portions 82 and 92 of the swing arm mechanisms 80 and 90 are grasped by the hands of the individual user, and allow upper body arm and shoulder exercising motions to be incorporated in conjunction with the reciprocal, elliptical exercising motion traced out by the user's feet. As can be more readily understood with reference to FIG. 1, the linking of the swing arm mechanisms 80 and 90 to the foot links 60 and 70, and the rotational securement of the swing arm mechanisms 80 and 90 to the forward upright member 20 of the frame 12 at the pivot points 84 and 94, results in generally rearward, arcuate motion of a hand-gripping portion being correspondingly linking to generally forward, arcuate motion of a respective foot support portion, and vice versa.

Importantly, the exercise device 10 of the present invention incorporates flexible coordinating members 100. These flexibly coordinating members 100 are incorporated in the linkage between the left hand-gripping portion 82 and foot support portion 66 and the linkage between the right hand-gripping portion 92 and foot support portion 76. The flexibly coordinating members 100 are sufficiently flexible and resilient to substantially link the movement of the foot support portions 66 and 76 to the movement of the hand-gripping portions 82 and 92, while permitting some degree of uncoordinated motion between the foot support portions 66 and 76, and the hand-gripping portions 82 and 92. This flexibly coordinated linkage between a user's upper body and lower body provides significant advantages over unforgivingly forcing exact coordination between a user's upper and lower body. In a preferred embodiment of the present invention illustrated in FIG. 1, a substantial portion of the swing arm mechanisms 80 and 90 themselves comprise the flexibly coordinating members 100, by being constructed of a material that is sufficiently flexible and resilient to substantially (but not totally) link the movement of the foot support portions 66 and 76 to the movement of the hand-gripping portions 82 and 92 (i.e., permitting some degree of uncoordinated motion between the foot support portions and the hand-gripping portions). Thus, in this embodiment, substantially the entire upper and lower portions of the swing arm mechanisms 80 and 90 are flexors (e.g., fiberglass/graphite rods or members).

To use the present invention, the user stands on the foot support portions 66 and 76 and grasps the hand-gripping portions 82 and 92. The user imparts a rearward stepping motion on one of the foot support portions and a forward stepping motion on the other foot support portion, thereby causing the transverse axle 36 to rotate in a clockwise direction (when viewed from the right side as shown in FIG. 1), due to the crank arm assemblies 50 and 52 coupling the motion of the foot links 60 and 70 to the rotation of the transverse axle 36. In conjunction with the lower body action, the user also imparts a substantially forward pushing motion on one of the hand-gripping portions and a substantially rearward pulling motion on the other hand-gripping portion. Due to the rotatable connection of the coupling regions 86 and 96 of the swing arm mechanisms 80 and 90 to the forward ends 62 and 72 of the foot links 60 and 70, and the rotational securement of the swing arm mechanisms 80 and 90 to the forward upright member 20 of the frame 12 at their pivot points 84 and 94, each hand-gripping portion moves forward as its respective foot support portion moves rearward, and vice versa.

The foot links 60 and 70 are attached to the transverse axle 36 by the crank arm assemblies 50 and 52 such that one foot support portion moves substantially forward as the other foot support portion moves substantially rearward. In this same fashion one hand-gripping portion moves forward as the other hand-gripping portion moves rearward (e.g., when the left hand-gripping portion 82 moves forward, the left foot support portion 66 moves rearward, while the right foot support portion 76 moves forward and the right hand-gripping portion 92 moves rearward). Therefore, the user can begin movement of the entire foot link and swing arm mechanism linkage by moving any foot support portion or hand-gripping portion, or preferably by moving all of them together.

As previously described, a flexibly coordinating member 100 is incorporated between each hand-gripping portion 82 and 92 and its respective foot support portion 66 and 76 to induce flexibly coordinated motion between the hand-gripping portions and the foot support portions, such that when one of the hand-gripping portions moves rearward the flexibly coordinating member 100 forces its respective foot support portion to move forward a substantially related percentage amount, and vice versa. This flexibly coordinated motion does however, allow a certain amount (depending upon the flexibility of the flexibly coordinating member 100) of uncoordinated motion between each respective hand-gripping portion and foot link. The relative movement between the hand-gripping portions and the foot support portions can be varied by modifying the location of the pivot points 84 and 94 along the length of the swing arm mechanisms 80 and 90. However, the flexible coordination provided by the flexibly coordinated members 100 does allow some degree of variation in the relative motion between the hand gripping portions 82 and 92 and the foot support portions 66 and 76.

As previously stated, in the preferred embodiment of the present invention illustrated in FIG. 1, the flexibly coordinating members comprise substantially the entire length of the swing arm mechanisms 80 and 90, which are constructed of a material that is sufficiently flexible and resilient to provide the above-described flexibly coordinating motion. In another preferred embodiment of the present invention the flexibly coordinating members 100 may represent a smaller percentage of the swing arm mechanisms 80 and 90. Reducing the portion of the swing arm mechanisms 80 and 90 that act as the flexibly coordinating members 100, and thus are composed of a flexible and resilient material, will likely increase the flexibility and resilience required of the material.

A preferred embodiment of the present invention may further include a friction break or other resistance adjustable mechanism (not shown). Preferably, the resistance adjustment mechanism would be associated with the flywheel 38 or the transverse axle 36 for the purpose of imposing drag on the wheel or the axle so as to increase the amount of exercise provided by the exercise device 10. The resistance adjustment mechanism may be adjusted by an adjustment knob (not shown) operating through a flexible cable (not shown) upon some type of frictional pad assembly (not shown). These types of resistance adjustment mechanisms and their associated assemblies are well-known to those skilled in the art. Other types of braking devices such as a magnetic brake and the like may also be similarly employed.

FIG. 2 represents a partial view of another preferred embodiment exercise device 110 constructed in accordance with the present invention. The alternate flexibly coordinated exercise device 110 partially shown in FIG. 2 is constructed and functions similarly to the exercise device 10 shown in FIG. 1. Accordingly, the exercise device 110 will be described only with respect to those components that differ from the components of the exercise device 10. In the alternate exercise device 110, the left and right swing arm mechanisms 80 and 90 each include spring link members 114 and 116 that act as the flexibly coordinating members of the device. Ideally, but not essentially, the spring link members 114 and 116 of the swing arm mechanism 80 and 90 are located substantially adjacent to the pivot points 84 and 94 (just below). The spring link members 114 and 116 could be located at other positions alone the length of the swing arm mechanisms 80 and 90 without departing from the scope of the present invention. The degree of flexibly coordinated motion (i.e., the amount of uncoordinated motion that is allowed) can be varied by selection of the size, thickness, and spring constant of the spring link members 114 and 116.

Referring now to FIG. 3, another preferred embodiment flexibly coordinating exercise device 120 is illustrated. The exerciser 120 shown in FIG. 3 is constructed and functions similarly to the exercise devices 10 and 110 shown in FIGS. 1 and 2 respectively. Accordingly, the alternate preferred embodiment exerciser 120 will be described only with respect to those components that differ from the components of the exercise devices 10 and 110. In the exercise device 120 the swing arm mechanism 90 is replaced by a right swing arm assembly 136 which includes an elastomeric torsion spring 124. It is to be understood the swing arm mechanism 80 is likewise replaced by a swing arm assembly similar to assembly 136. Swing arm assembly 136 contains an upper swing arm 138, a lower swing arm 140, an upper connector collar 142, a lower connector hub 144, and a connecting elastomeric torsion spring 124.

The elastomeric torsion spring 124 connects the upper swing arm 138 to the lower swing arm 140 by linking the upper connector collar 142 to the lower connector hub 144 of the lower swing arm in flexibly coordinated motion. The hub 144 is fixedly connected to the upper knuckle 141 of lower swing arm 140. Both the hub 144 and knuckle 141 have a central through hole for engaging over the distal end of pivot shaft 146. The elastomeric torsion spring 124 is bonded to the inside diameter of collar 142 and to the outside diameter of hub 144, thereby to substantially relate the motion of the upper swing arm 138 to the motion of the lower swing arm 140 while permitting some degree of uncoordinated motion between the upper swing arm and the lower swing arm. The swing arm assembly 136 rotates about the pivot shaft 146, which is supported by upright member 20. The degree of flexibly coordinated motion provided by the elastomeric torsion spring 124 (i.e., the amount of uncoordinated motion that the elastomeric torsion springs allow) can be varied by selection of the elastomeric material used to comprise the elastomeric torsion spring 124 (i.e., the flexibility and resilience of the material).

FIG. 4 illustrates another preferred embodiment of the present invention composed of a flexibly coordinated exercise device 150. The exerciser 150 shown in FIG. 4 is constructed and functions similarly to the exercise devices 10, 110, and 120 shown in FIGS. 1–3, respectively. Accordingly, the exerciser 150 will be described only with respect to those components that differ from the components of the exercise devices 10, 110, and 120.

In the exercise device 150, left and right elastomeric members 152 and 154 connect the coupling regions 86 and 96 of the swing arm mechanisms 80 and 90 to the forward ends 62 and 72 of the foot links 60 and 70. The elastomeric members 152 and 154 provide flexibly coordinated motion between the hand gripping portions 82 and 92 and the foot support portions 66 and 76. The elastomeric members 152 and 154 are constructed of a material that is sufficiently flexible and resilient to substantially relate the movement of the foot support portions to the movement of the hand gripping portions, while permitting some degree of uncoordinated motion between the foot support portions and the hand gripping portions. Alternatively, the members 152 and 154 may be rigid and have a torsion spring interposed between the members 152 and 154, and the forward ends 62 and 72 of the foot links 60 and 70. In still an additional embodiment, the members 152 and 154 may be rigid and have a torsion spring interposed between the members 152 and 154, and the coupling regions 86 and 96 of the swing arms 80 and 90.

Figure 5:
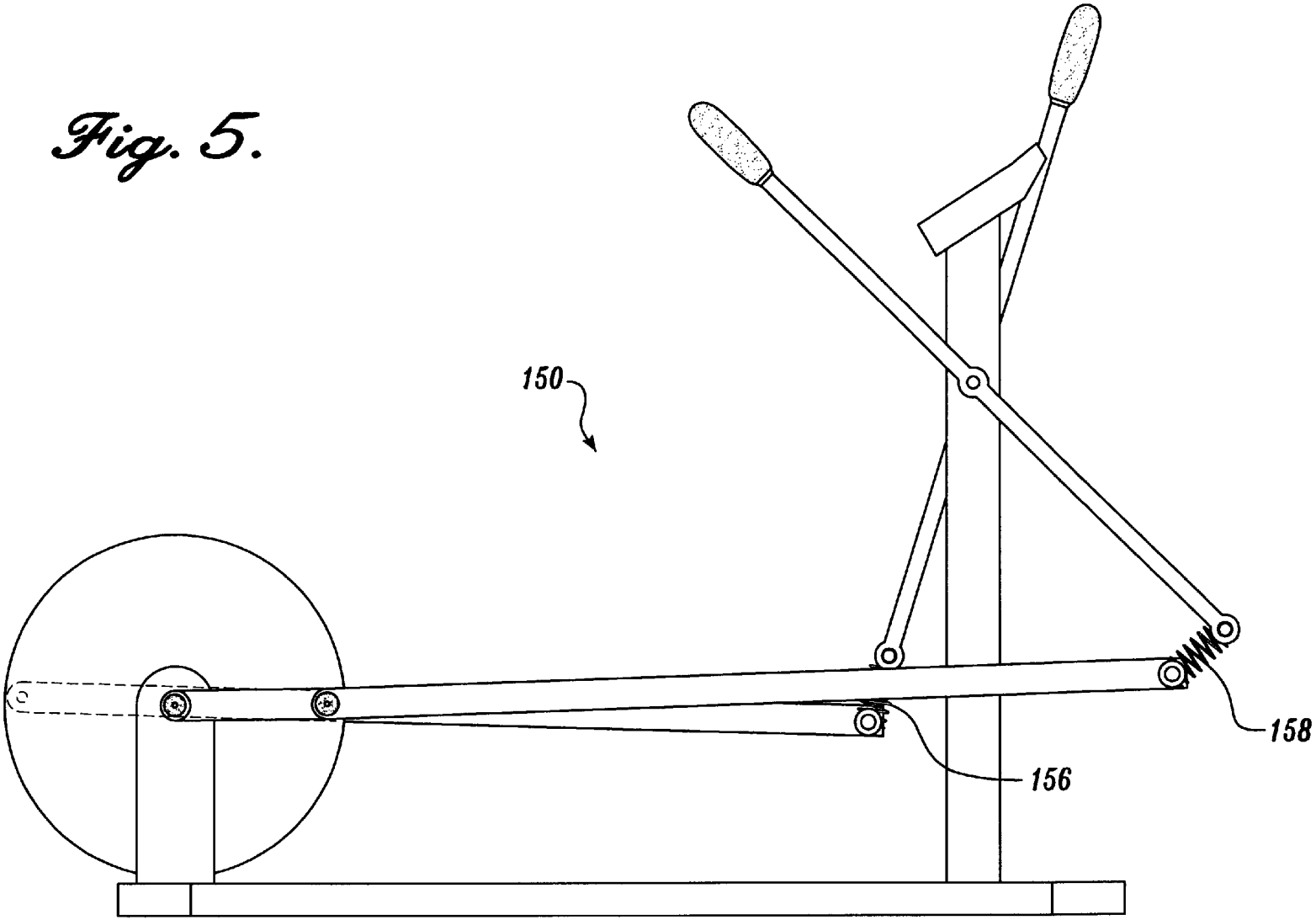
FIG. 5 illustrates a side view of the flexibly coordinated exerciser of the present invention, that utilizes spring members at the connections between the swing arms and the foot links as flexibly coordinating members.

As shown in FIG. 5, in another preferred embodiment of the present invention, spring links 156 and 158 could also be used in place of elastomeric members 152 and 154 and would provide the same type of flexibly coordinated motion between the hand gripping portions 82 and 92 and the foot support portions 66 and 76 in the exercise device 150.

In another aspect of the present invention, any of the above-described preferred embodiments may further contain flexibly coordinated mechanisms in the linkage between the left and right foot support portions 66 and 76 of the left and right foot links 60 and 70 that substantially relate the movement of the foot links to each other while permitting some degree of uncoordinated motion between the foot links. Specifically, flexibly coordinating mechanisms 104 similar to those described above (e.g., such as the elastomeric torsion spring 124) may be incorporated between each foot link 60 and 70 and their respective crank arm assembly 50 and 52. In another preferred embodiment, the flexibly coordinating mechanisms 106 (e.g., such as elastomeric torsion springs) may be incorporated between each coupling mechanism 50 and 52 and the transverse axle 36. In still another preferred embodiment, the flexibly coordinating mechanism may be configured as a flexibly coordinated, bifurcated transverse axle (not shown), that substantially relates the movement of the foot links to each other, while permitting some degree of uncoordinated motion between the foot links, and which replaces the transverse axle 36.

The present invention has been described in relation to a preferred embodiment and several preferred alternate embodiments. One of ordinary skill after reading the foregoing specification, may be able to effect various other changes, alterations, and substitutions or equivalents thereof without departing from the concepts disclosed. It is therefore intended that the scope of the letters patent granted hereon will be limited only by the definitions contained in the appended claims and equivalents thereof The embodiments of the invention in which an exclusive property or privilege is claimed are defined as follows:

1. An exercise device, comprising:

a frame having a transverse axis defined relative to the frame;

a first and second foot link, each foot link including a foot support portion;

a first and second coupling mechanism, each coupling mechanism configured to operatively associate with a respective one of said foot links for linking the foot links to the transverse axis such that the foot support portion of each foot link travels in a reciprocal path as the transverse axis rotates;

first and second swing arm mechanism, each swing arm mechanism including a gripping portion, a pivot point and a coupling region, wherein the coupling region of each swing arm mechanism is operatively associated with each foot link; and first and second flexibly coordinating linkages that substantially and resiliently link the movement of the foot support portions to the movement of the hand gripping portions of the swing arm mechanisms, while permitting some degree of uncoordinated motion between the foot support portions and the hand gripping portions.

2. The exercise device of claim 1, wherein at least a portion of the swing arm mechanisms comprise the first and second flexibly coordinating linkages which are constructed of a material that is sufficiently flexible and resilient to link the movement of the foot support portions to the movement of the hand gripping portions of the swing arm mechanisms, while permitting some degree of uncoordinated motion between the foot support portions and the hand gripping portions.

3. The exercise device of claim 2, wherein:

the swing arm mechanisms comprise elongate arm portions extending between the gripping, portions and the coupling portions; and substantially the entire length of the arm portions comprise the first and second flexibly coordinating linkages which are constructed of a material that is sufficiently flexible and resilient to link the movement of the foot support portions to the movement of the hand gripping portions of the swing arm mechanisms, while permitting some degree of uncoordinated motion between the foot support portions and the hand gripping portions.

4. The exercise device of claim 1, wherein the swing arm mechanisms include spring link members that comprise the first and second flexibly coordinating linkages.

5. The exercise device of claim 4, wherein the spring link members of the swing arm mechanisms are located substantially adjacent to the pivot points of the swing arm mechanisms.

6. The exercise device of claim 1, wherein the swing arm mechanisms include elastomeric torsion members that are located substantially adjacent to the pivot points and comprise the first and second flexibly coordinating linkages that flexibility connect the gripping portions to the coupling regions.

7. The exercise device of claim 1, wherein spring members operatively associate the foot links with coupling region of the swing arm mechanisms and comprise the first and second flexibly coordinating linkages.

8. The exercise device of claim 1, wherein elastomeric members operatively associate the foot links with the coupling regions of the swing arm mechanisms and comprise the first and second flexibly coordinating linkages.

9. The exercise device of claim 1, wherein the coupling mechanisms comprise rotational crank arms that pivotally associate the transverse axis with the foot links, wherein at least a portion of the coupling mechanisms rotate about the transverse axis.

10. The exercise device of claim 1, further including a flywheel disposed for rotation in operative connection with the transverse axis.

11. The exercise device of claim 1, further including a resistance system configured in operatively associated with the transverse axis.

12. The exercise device of claim 1, wherein the frame further comprises a forward portion and an upright portion extending upwardly from the forward portion of the frame, and the first and second swing arm mechanisms are rotatably coupled to the forward upright portion extending upwardly from the forward portion of the fame of the frame at the pivot points of the swing arm mechanisms.

13. The exercise device of claim 1, further comprising at least one flexibly coordinating mechanism in operative association between the foot links that substantially relates the movement of the first and second foot links to each other, while permitting some degree of uncoordinated motion between the foot links.

14. The exercise device of claim 13, wherein flexibly resilient members between the foot links and the coupling mechanisms are the at least one flexibly coordinating mechanism in operative association between the foot links that substantially relates the movement of the first and second foot links to each other, while permitting some degree of uncoordinated motion between the foot links.

15. The exercise device of claim 13, wherein flexibly resilient members between the coupling mechanisms and the transverse axis are the at least one flexibly coordinating mechanism in operative association between the foot links that substantially relates the movement of the first and second foot links to each other, while permitting some degree of uncoordinated motion between the foot links.

16. The exercise device of claim 13, wherein a flexibly coordinated, bifurcated transverse axis is the at least one flexibly coordinating mechanism in operative association between the foot links that substantially relates the movement of the first and second foot links to each other, while permitting some degree of uncoordinated motion between the foot links.

17. An exercise device, comprising:

a frame having a forward end portion, a rearward end portion and an upright portion;

an axis mounted on the frame and transversely oriented thereto;

a first and second foot link, each foot link including a first end portion, a second end portion and a foot support portion therebetween;

a first and second coupling mechanism, each coupling mechanism configured to operatively associate with a respective one of said foot links for linking the second end portion of the foot links to the transverse axis such that the foot support portion of each foot link travels in a reciprocal path as the transverse axis rotates; and first and second swing arm assembly, each swing arm assembly including a gripping portion, a pivot point, a coupling region, and a flexibly coordinating linkage, wherein the coupling region of each swing arm assembly is operatively associated with the respective first end portion of each foot link, and the flexibly coordinating linkage substantially and resiliently links the movement of each foot support portion to the movement of each respective hand gripping portion of the swing arm mechanism, while permitting some degree of uncoordinated motion between the foot support portions and the hand gripping portions.

18. The exercise device of claim 17, wherein a substantial portion of the first and second gripping portions and coupling regions comprise the first and second flexibly coordinating linkages, which are constructed of a material that is sufficiently flexible and resilient to link the movement of the foot support portions to the movement of the hand gripping portions of the swing arm mechanisms, while permitting some degree of uncoordinated motion between the foot support portions and the hand gripping portions.

19. The exercise device of claim 17, wherein the swing arm assemblies include spring link members that comprise the first and second flexibly coordinating linkages.

20. The exercise device of claim 19, wherein the spring link members of the swing arm assemblies are located substantially adjacent to the pivot points of the swing arm assemblies.

21. The exercise device of claim 17, wherein the swing arm assemblies include elastomeric torsion members that are located substantially adjacent to the pivot points and comprise the first and second flexibly coordinating linkages that flexibility connect the gripping portions to the coupling regions.

22. The exercise device of claim 17, wherein spring members operatively associate the second end portion of the foot links with coupling region of the swing arm assemblies and comprise the first and second flexibly coordinating linkages.

23. The exercise device of claim 17, wherein elastomeric members operatively associate the second end portion of the foot links with coupling region of the swing arm assemblies and comprise the first and second flexibly coordinating linkages.

24. The exercise device of claim 17, wherein spring links operatively associate the second end portion of the foot links with coupling region of the swing arm assemblies and comprise the first and second flexibly coordinating linkages.

25. The exercise device of claim 17, wherein the coupling mechanisms comprise rotational crank assemblies that pivotally associate the transverse axis with the foot links, wherein at least a portion of the coupling mechanisms rotate about the transverse axis.

26. The exercise device of claim 17, further including a flywheel disposed for rotation in operative connection with the transverse axis.

27. The exercise device of claim 17, further including a resistance system configured in operatively associated with the transverse axis.

28. The exercise device of claim 17, wherein the first and second swing arm assemblies rotatable connect to the upright portion of the frame at the pivot points of the swing arm assemblies.

29. The exercise device of claim 17, further comprising at least one flexibly coordinating mechanism in operative association between the foot links that substantially relates the movement of the first and second foot links to each other, while permitting some degree of uncoordinated motion between the foot links.

30. The exercise device of claim 29, wherein flexibly resilient members between the foot links and the coupling mechanisms are the at least one flexibly coordinating mechanism in operative association between the foot links that substantially relates the movement of the first and second foot links to each other, while permitting some degree of uncoordinated motion between the foot links.

31. The exercise device of claim 29, wherein flexibly resilient members between the coupling mechanisms and the transverse axis are the at least one flexibly coordinating mechanism in operative association between the foot links that substantially relates the movement of the first and second foot links to each other, while permitting some degree of uncoordinated motion between the foot links.

32. The exercise device of claim 29, wherein a flexibly coordinated, bifurcated transverse axis is the at least one flexibly coordinating mechanism in operative association between the foot links that substantially relates the movement of the first and second foot links to each other, while permitting some degree of uncoordinated motion between the foot links.

33. An exercise device, comprising:

a frame having a transverse axis defined relative to the frame;

a first and second swing arm/foot track linkage, each swing arm/foot track linkage including a hand grip, a pivot point, a coupling region, a flexibly coordinating linkage, and a foot support track, wherein each coupling region is operatively associated with a respective foot support track, and wherein each flexibly coordinating linkage substantially and resiliently links the movement of the foot support tracks to the movement of the hand grips, while permitting some degree of uncoordinated motion between the foot support tracks and the hand grips; and a first and second coupling mechanism, each coupling mechanism configured to operatively associate with a respective one of said foot support tracks for linking the swing arm/foot track linkages to the transverse axis such that the foot support tracks of each swing arm/foot track linkage travels in a reciprocal path as the transverse axis rotates.

* * * * *

UNITED STATES PATENT AND TRADEMARK OFFICE

CERTIFICATE OF CORRECTION

PATENT NO. : 6,277,055 B1
DATED : August 21, 2001
INVENTOR(S) : J.S. Birrell et al.

It is certified that error appears in the above-identified patent and that said Letters Patent is hereby corrected as shown below:

Title page,
Item [73], Assignee, "Illinois Tool Works, Inc.," should read -- Illinois Tool Works Inc., --

Column 1,
Line 7, "1999.," should read -- 1999. --
Line 23, "equipment have" should read -- equipment has --
Line 29, "exercise equipment, is" should read -- exercise equipment is --
Line 36, "art, however" should read -- art; however, --
Line 42, "than a stationary" should read -- than does a stationary --
Line 43, "thereby, limits" should read -- thereby limits --
Line 47, "bicycles, however," should read -- bicycles; however, --
Line 56, "prior art, is" should read -- prior art is --

Column 2,
Line 11, "motion produced" should read -- of motion produced --
Line 19, "that provides" should read -- that provide --
Line 60, "in operatively associated" should read -- in operative association --

Column 3,
Line 22, "with coupling" should read -- with the coupling --

Column 4,
Line 59, "members are utilized" should read -- members are utilized, --

Column 6,
Line 5, "70 can" should read -- 70, can --
Line 51, "linking to generally" should read -- linked to a generally --

Column 7,
Line 54, "moves rearward" should read -- moves rearward, --
Line 58, "motion does however," should read -- motion does, however, --

Column 8,
Line 45, "alone" should read -- along --

Column 10,
Line 18, "equivalents thereof" should read -- equivalents thereof. --
Line 33, "first and second swing arm mechanism," should read -- first and second swing arm mechanisms, --

UNITED STATES PATENT AND TRADEMARK OFFICE

CERTIFICATE OF CORRECTION

PATENT NO. : 6,277,055 B1
DATED : August 21, 2001
INVENTOR(S) : J.S. Birrell et al.

It is certified that error appears in the above-identified patent and that said Letters Patent is hereby corrected as shown below:

Column 10 cont'd,
Line 55, "gripping, portions" should read -- gripping portions --

Column 11,
Line 11, "with coupling region" should read -- with the coupling regions --
Line 27, "in operatively associated" should read -- in operative association --
Line 34, delete "of the fame"

Column 12,
Line 10, "first and second swing arm assembly," should read -- first and second swing arm assemblies, --
Line 45, "with coupling region" should read -- with the coupling region --
Line 50, "with coupling region" should read -- with the coupling region --
Line 55, "with coupling region" should read -- with the coupling region --
Line 66, "in operatively associated" should read -- in operative association --

Column 13,
Line 2, "rotatable" should read -- rotatably --

Signed and Sealed this

Fifth Day of November, 2002

*Attest:*

*Attesting Officer*

JAMES E. ROGAN
*Director of the United States Patent and Trademark Office*